United States Patent [19]

Chan et al.

[11] Patent Number: 5,025,643

[45] Date of Patent: Jun. 25, 1991

[54] HOLDING CLIP

[75] Inventors: David Chan; Raymond Chan, both of Kowloon, Hong Kong

[73] Assignee: International Cultured Pearl Company, Inc., New York, N.Y.

[21] Appl. No.: 485,576

[22] Filed: Feb. 27, 1990

[51] Int. Cl.[5] ..... A44C 7/00

[52] U.S. Cl. ..... 63/12; 63/14.5

[58] Field of Search ..... 63/12, 13, 14.3, 14.4, 63/14.5, 14.1; 24/499

[56] References Cited

U.S. PATENT DOCUMENTS

| | | | |
|---|---|---|---|
| 2,391,635 | 12/1945 | Mark | 63/14.5 |
| 2,447,350 | 8/1948 | Levesque | 63/14.5 |
| 2,841,853 | 7/1958 | Guyot | 63/14.1 |
| 4,675,953 | 6/1987 | Higgs | 24/499 |
| 4,907,424 | 3/1990 | Reinstein et al. | 63/12 |

OTHER PUBLICATIONS

Metal City Findings Advertisement, Englewood, N.J., no date provided.

Metal City Findings Catalogue, p. 29, no date provided.

*Primary Examiner*—James R. Brittain

*Attorney, Agent, or Firm*—McAulay Fisher Nissen Goldberg & Kiel

[57] ABSTRACT

A jewelry clip is disclosed which includes a base having spaced-apart first and second openings and an arcuate retaining wire having first and second ends connected by a curved portion. The ends of the wire are received and held in the respective openings of the base to permit the wire to be rotatable on the base. The retaining wire has a rotational position of maximum stored energy and positions of lesser stored energy. In operation, the retaining wire will tend to rotate away from the position of maximum stored energy to a position of lesser stored energy to provide a pressure against an item of jewelry to which the base is attached.

8 Claims, 3 Drawing Sheets

HOLDING CLIP

BACKGROUND OF THE INVENTION

This invention relates in general to a holding clip and, more particularly, to one that is adapted to be used for holding jewelry on a person and specifically for holding an earring onto a wearer's earlobe.

There are a number of known devices used for securing an earring to a wearer's ear. One type involves a pierced ear and employs a pin or post which extends through a hole in the earlobe and is retained by some known retaining mechanism. A second type is a well known screw and clamp arrangement in which the wearer screws a holding member against the inner ear and thus squeezes the lobe between the decorative portion of the earring and the clamp. There also is a known over-center or toggle type of mechanism which provides a clamping force to the earlobe to retain the earring.

The over-center or toggle type of arrangement is widely used and employs a holding loop which has legs that ride over cammed surfaces on an associated bracket. The cammed surface is essentially a V-shaped surface. The loop is in the form of a circular wire which is disposed for movement from a non-retaining state on one side of the V-shaped surface to a retaining state on the other side of the V-shaped surface. That is, as the loop moves from its non-retaining state and passes over the point or apex of the V, the loop is caused to ride down the cammed surface to its retaining state against the inner surface of the wearer's earlobe.

Because of the size of the design with very short camming surfaces (perhaps a 0.040 inch pitch achieved in a ninety degree rotation), there is substantial frictional sliding forces between the camming surface and the legs of the loop. This results in substantial wear on the line contact surface between the circular wire and the cammed surface. Because of the small amount of overall distance moved, this wear changes the geometry significantly and substantially degrades performance.

Another type of known over-center mechanism is a spring action clamp arrangement that is sometimes used with jewelry products. Again, in part because of the size of the device and because the nature of the leaf spring, substantial sliding friction exists which results in wear and degradation in terms of performance.

The purpose of this invention is to provide an improved earring holding device which meets a number of separate criteria for any such device to be effective. In order for the present earring holding device to supplant the well known and well tried devices in the marketplace it must have improved features from the point of view of reduced complexity, reduced number of parts, ease of assembly, minimum cost, small size and weight, aesthetic acceptability, comfort, adequate holding power and ease of use.

Accordingly, it is an object of this invention to provide an earring holding device which meets all of the above objectives and, by contrast with any one type of prior holding device, has improvement features representing most of the above criteria.

Because the problem of wear that occurs with the use of the two known over-center types of mechanisms; one employing a leaf spring and one employing two cammed surfaces, it is an important purpose of this invention to provide an improved device which has the simplicity of use of these two types of clamping mechanisms, and yet avoids the degradation due to wear as the holding device rides over the leaf spring or cams as the case may be.

BRIEF DESCRIPTION

In brief, one embodiment of this invention involves a base and a rotatable retaining spring mounted member on the base. The base is a small flat tapered elliptical member which serves the purpose of providing a base on which the retaining member can rotate and also provides a point of connection to the earring. It is difficult to visualize the retaining member without viewing the pictures. Suffice it to say here that the retaining member is a wire that has approximately a horse shoe shaped or omega shaped profile with the end legs turned in toward one another instead of away from one another. The retaining wire in an unstressed state, prior to assembling on the base, has the two in-turned legs in axial alignment with one another. Two spaced apart through-openings in the base are adapted to receive these two legs. The two legs mounted on the base are displaced from one another so that they are no longer co-axial. Swaging the ends of the legs prevents the legs from coming out of the openings. A slip fit relationship between the legs and the openings means the legs can rotate in the openings. As a consequence, the entire retaining wire can rotate in the opening of the base.

Because of the axial displacement of the two legs when the retaining wire is mounted to the base, a stress (including a significant torsional strain) is put onto the retaining wire. This stress causes the retaining wire to rotate between two lesser stored energy positions as if it were riding over a cam; which positions correspond to a non-retaining state and a retaining state of the wire. The wire element between the two legs is bent in a fashion that, when the base is properly mounted on an earring, will permit the central curved portion of the retaining wire to abut against the inside of a wearer's earlobe when the wire is in its retained state.

Additional features of the invention will become apparent from a consideration of the following detailed description when taken in conjunction with the accompanying drawings.

BRIEF DESCRIPTION OF THE DRAWINGS

FIG. 4 illustrates the retaining wire and base having the same stable relationship as they have in FIG. 2.

DESCRIPTION OF THE PREFERRED EMBODIMENTS

Figure 1:
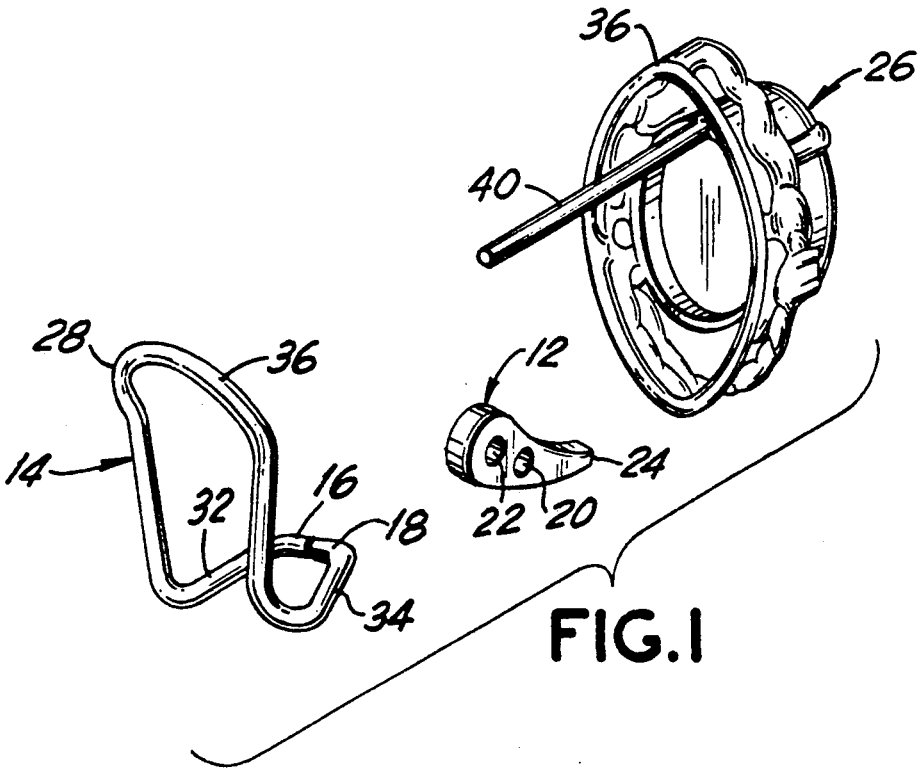
FIG. 1 is an exploded perspective view of an embodiment of this invention illustrating the retaining wire, base and typical decorative portion of an earring, all prior to assembly.

The Figures in the drawings all relate to the same embodiment. The clip 10 of this invention is shown in an earring embodiment. The clip itself is composed of two elements: a base 12 preferably made of metal and a retaining wire 14. The retaining wire 14 is held in the base 12 by virtue of legs 16, 18 at the ends of the retaining wire 14, which legs are held in openings 20, 22 in the base 12. The end 24 of the base 12 is permanently affixed as by welding to the decorative earring portion 26. FIG. 1 shows the position of the legs 16, 18 before assembly. The legs 16, 18 are preferably, as shown, co-axial.

Figure 12:
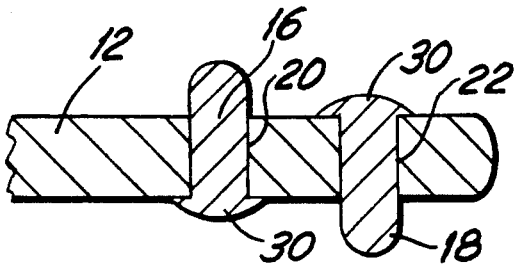
FIG. 12 is a sectional view along the plane 12—12 of FIG. 10 showing the manner in which the legs of the retaining wire are cold welded into permanent position on the base.

The retaining wire 14 has a generally U-shaped main portion 28 with the first and second turned-in legs 16, 18 at the ends of the U-shaped main portion 28. These legs 16, 18 are in axially alignment when the retaining wire 14 is in its unstressed state prior to being assembled on the base 12. Openings 20, 22 on base 12 extend through the base 12 and are, as shown, displaced from one another. Leg 18 slides into opening 20 and extends through opening 20. Legs 16 slides into opening 22 and extends through opening 22. This arrangement can be best visualized by looking at FIG. 12. The two legs 16, 18 are axially displaced from one another, extend through respective base openings 20, 22 and have the ends of these legs swaged or cold welded into place by hammering on the end to form the holding head or rivet head 30 as shown. These legs 16, 18 have a slip fit relationship in the openings 20, 22 so that they are free to rotate within these openings and thus permit the retaining wire 14 to rotate between the non-retaining position shown in FIG. 2 and the retaining position shown in FIG. 3.

In one embodiment, the retaining wire 14 has a length from end to end of approximately 35 mm and the axial displacement of holes 20, 22 in the base 12 is approximately 1 mm. In another embodiment, for larger size jewelry, the retaining wire 14 has a length from end to end of approximately 46 mm and the axial displacement of holes 20, 22 in the base 12 is approximately 2 mm. The gauge of the wire for both embodiments is the same; being approximately 1 mm.

Figure 2:
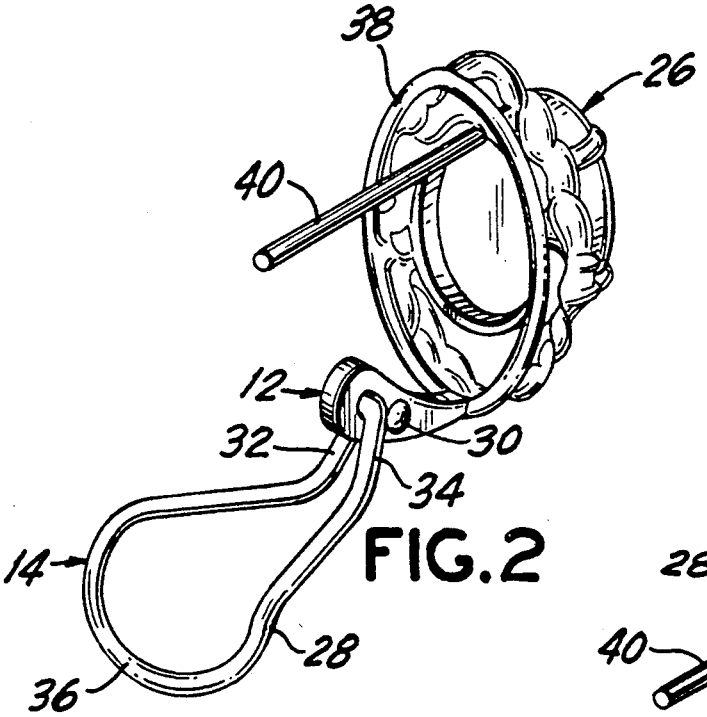
FIG. 2 is a perspective view illustrating the three elements of FIG. 1 assembled with the retaining wire in a first stable state, that state being a non-retaining state.
Figure 3:
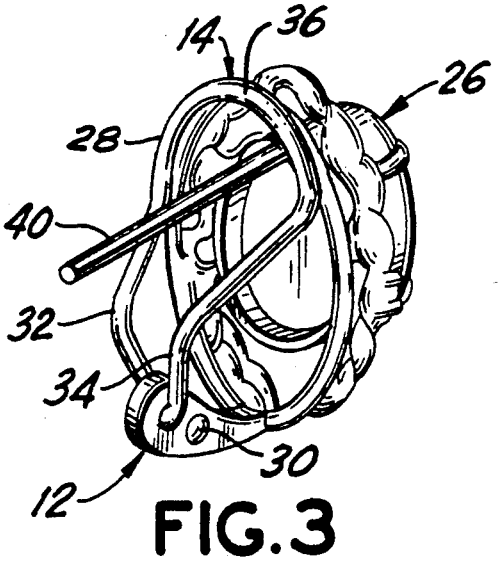
FIG. 3 is a perspective view similar to that of FIG. 2 with the retaining wire in a second stable state, that state being a retaining state.
Figure 4:
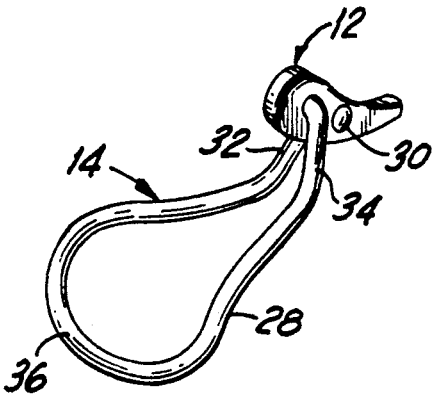
FIG. 4 is a perspective view of the retaining wire assembled on the base showing the ends of the retaining wire displaced from one another as compared with the unstressed state shown in FIG. 1.
Figure 5:
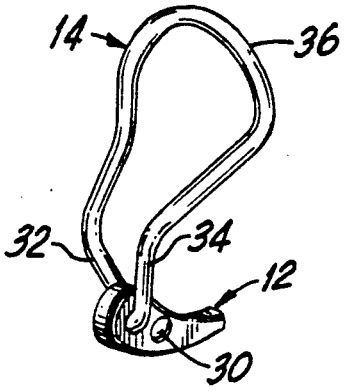
FIG. 5 is a perspective view showing the retaining wire and base having the same stable state relationship that they have in FIG. 3.
Figure 6:
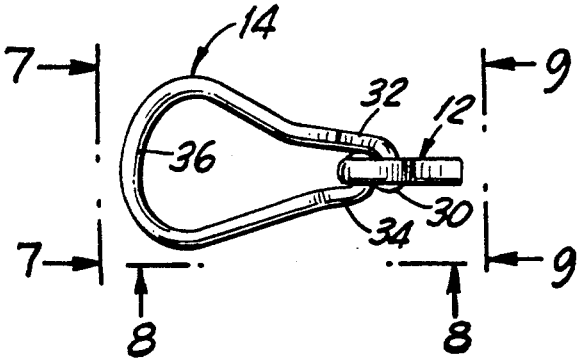
FIG. 6 is a top plan view of the wire and base assembly of FIG. 4.
Figure 7:
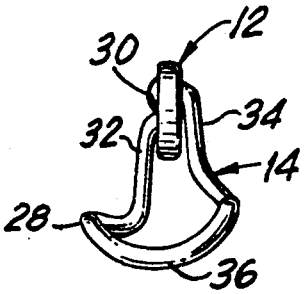
FIG. 7 is an end view taken along the plane 7—7 of FIG. 6.
Figure 8:
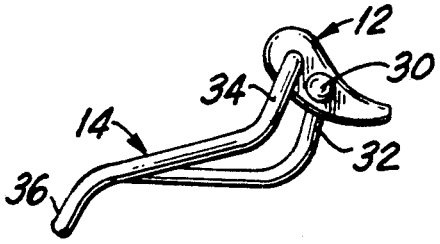
FIG. 8 is a first side view taken along the plane 8—8 of FIG. 6.
Figure 9:
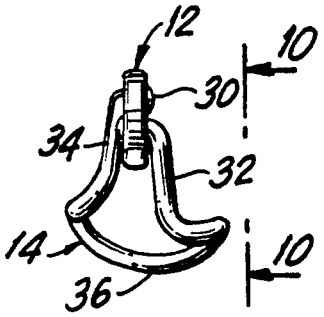
FIG 9 is an end view taken along the plane 9—9 of FIG. 6.
Figure 10:
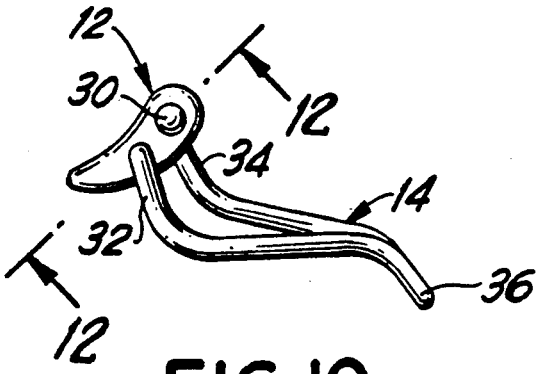
FIG. 10 is a second side view taken along the plane 10—10 of FIG. 9.
Figure 11:
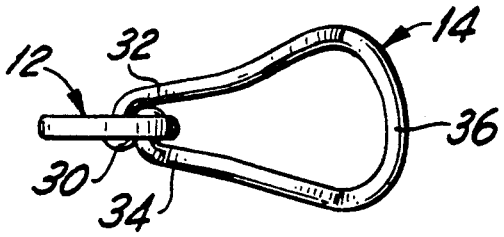
FIG. 11 is a bottom plan view of the wire and base assembly of FIG. 10.

Axially displacing the legs 16, 18 in a direction parallel to the plane of FIGS. 6 and 11 creates certain torsional forces in the main body 28 of the retaining wire 14 that causes the wire to rotate to either (a) the relatively stable state as shown in FIG. 2 in which the wire is in its nonretaining state or position or (b) the stable state as shown in FIG. 3 in which the wire is in its retaining state or position. Both the FIG. 2 state and FIG. 3 state are relatively stable in that the retaining wire, when displaced from the states shown, will tend to rotate to one or the other of the two positions.

Essentially, when retaining wire 14 is in the open position shown in FIG. 2, rotation of the retaining wire about one-quarter to one-third of the way toward the FIG. 3 retaining state will cause the wire to pass over a "center point" whereupon the wire 14 will then snap into the FIG. 3 retaining state.

The exact configuration and shape of the main portion 28 of the retaining wire is a function of the dimensions of the decorative earring piece 26 which is to be held in position. As it is most clearly seen in FIGS. 1 and 3, the main portion 28 of the retaining wire 14 has first and second end portions 32 and 34 and a curved connecting portion 36 that is shaped to rest against the earlobe of the wearer. The end portions 32 and 34 terminate in legs 16 and 18, respectively. The extent to which the curved portion 36 is bent away from the end portions 32, 34 and flared outwardly is, in large part, a function of the particular dimensions of the decorative piece 26 with which it is intended to operate.

The torsion created in the end portions 32, 34 by the displacement of the legs 16, 18 is what causes the entire retaining spring 14 to forcefully snap into the FIG. 3 retaining state and to hold the earlobe between the connecting portion 36 and the rim 38 of the decorative piece 26. In those instances when the earring portion 26 is to be worn by a person having pierced earlobes, portion 26 includes a post 40 which passes through the earlobe opening. The retaining wire 14 is appropriately sized to permit the connecting portion 36 of main portion 28 to pass over post 40 when the wire rotates to the retaining position of FIG. 3.

In general terms, the displacement of the legs 16, 18 of the wire 14 when assembled into the base 12 sets up a stress in the wire. Since the wire 14 has elastic qualities, it operates as a spring element and will tend to position itself to reduce the amount of stored elastic energy to a minimum.

Without analyzing all of the complex force and stress resolution as the retaining wire rotates relative to the base, it should be noted that it takes less energy to move the coaxial legs 16, 18 to a non-coaxial position by moving them up and down out of the approximate plane of the wire ends 32, 34 than it does to create the same displacement to a non co-axial position within the approximate plane of the wire ends. It is the latter displacement which is used to assemble the retaining wire 14 on the base 12.

While a preferred embodiment of the invention has been shown and described in detail, it will be readily understood and appreciated that omissions, changes and additions may be made without departing from the spirit and scope of the invention.

We claim:

1. An earring clip adapted to be mounted on the back surface of an earring comprising:

a base and a curved retaining wire, said base having an attachment end adapted to be connected to the back surface of the earring, said base having first and second openings therein, said openings being offset from one another, both of said openings spaced from said attachment end, said retaining wire having first and second opposed end legs pivotally mounted respectively in said first and second openings of said base, the mounting of said retaining wire to said base imparting a stress to said retaining wire causing said retaining wire to be movable between an open position and a holding position, said retaining wire having a curved holding central portion connected to said first and second legs by first and second intermediate portions, said curved central portion of said retaining wire being biased by the stress of said retaining wire toward the back surface of the earring to which the clip is mounted when said retaining wire is in said holding position, said base and said intermediate portions of said retaining wire defining a space adjacent to the back surface of the earring to which the clip is mounted that is adapted to accommodate the earlobe of the wearer, said retaining wire comprises in linear order, said first leg, said first intermediate portion, said curved central portion, said second intermediate portion and said second leg, said first leg and said first intermediate portion forming a dogleg and defining a first plane, said second leg and said second intermediate portion forming a dogleg and defining a second plane, said first and second planes being approximately parallel to one another, said curved central portion having a first end and a second end, said first end of said curved central portion and said first intermediate portion forming a dogleg and defining a third plane, said second end of said curved central portion and said second intermediate portion forming a dogleg and defining a fourth plane, said third and fourth planes forming an acute angle relative to one another.

2. The earring clip of claim 1 wherein:

said base and said end legs extend a distance which is substantially less than the span of said curved central portion of said retaining wire.

3. The earring clip of claim 2 wherein:

said base has first and second opposed surfaces extending away from said attachment end.

4. The earring clip of claim 3 wherein:

said first and second openings extend through said base from said first surface to said second surface.

5. The earring clip of claim 1 wherein:

said base has first and second opposed surfaces extending away from said attachment end.

6. The earring clip of claim 5 wherein:

said first and second openings extend through said base from said first surface to said second surface.

7. An earring clip comprising:

a base having an attachment end and first and second opposed surfaces extending away from said attachment end, a first opening in said first surface of said base and a second opening in said second surface of said base, said openings being off-set from one another on said base by a predetermined distance, said openings being spaced from said attachment end, and a generally arcuate retaining wire having first and second end portions connected by a generally U-shaped main portion, said main portion having a first intermediate portion and a second intermediate portion connected by a curved connection portion, said retaining wire having first and second opposed end legs extending respectively from said first and second end portions, said first leg being received and held in said first opening of said base and said second leg being received and held in said second opening of said base, said legs received in said openings imparting a stress to said retaining wire, said retaining wire being rotatable on said legs in said openings of said base, said arcuate retaining wire comprising in linear order, said first leg, said first end portion, said first intermediate portion, said curved connection portion, said second intermediate portion, said second end portion and said second leg, said first leg and said first end portion forming a dogleg and defining a first plane, said first end portion and said first intermediate portion forming a dogleg and defining a second plane, said curved portion defining a third plane, said second intermediate portion and said second end portion forming a dogleg and defining a fourth plane, and said second end portion and said second leg forming a dogleg and defining a fifth plane, said first plane and said fifth plane being approximately parallel to one another, said second plane and said fourth plane having an acute angle therebetween, said second and fourth planes being approximately perpendicular to said first and fifth planes, respectively, said third plane being approximately perpendicular to said second and fourth planes.

8. The earring clip of claim 7 wherein:

said base and said end legs extend a distance which is substantially less than the span of said curved connection portion of said retaining wire.

* * * * *